US007712913B2

(12) United States Patent
Gardenier et al.

(10) Patent No.: US 7,712,913 B2
(45) Date of Patent: May 11, 2010

(54) LIGHTED PANEL SYSTEM FOR HOT TUB, SPA, OR POOL INSTALLATION

(75) Inventors: W. John Gardenier, Wallingford, CT (US); Michael David Holtsnider, Moorpark, CA (US)

(73) Assignee: Thermospas, Inc., Wallingford, CT (US)

( * ) Notice: Subject to any disclaimer, the term of this patent is extended or adjusted under 35 U.S.C. 154(b) by 91 days.

(21) Appl. No.: 12/035,842

(22) Filed: Feb. 22, 2008

(65) Prior Publication Data

US 2009/0213590 A1 Aug. 27, 2009

(51) Int. Cl.
*F21V 33/00* (2006.01)

(52) U.S. Cl. ..... 362/101

(58) Field of Classification Search ..... 362/101
See application file for complete search history.

(56) References Cited

U.S. PATENT DOCUMENTS

| | | | | |
|---|---|---|---|---|
| 4,667,479 | A | 5/1987 | Doctor | |
| 6,595,671 | B2 * | 7/2003 | Lefebvre et al. | 362/545 |
| 6,752,517 | B2 * | 6/2004 | Hildebrand et al. | 362/231 |
| 6,755,550 | B1 | 6/2004 | Lackey | |
| 7,244,037 | B2 | 7/2007 | Koren | |
| 7,396,143 | B2 * | 7/2008 | Sloan | 362/249.12 |

OTHER PUBLICATIONS

FMLINK, Facilities Management News, Una Terra introduces LED floor and wall tile collection, plus Pyrex pool, downloaded Aug. 13, 2007, available at www.fmlink.com/News/Articles/news.cgi?catid=1006&display=article&id=21054.

INYOPOOLS.COM, Swimming Pool Lighting, downloaded Aug. 13, 2007, © 2001-2007 Inyp Products Inc., available at www.inyopools.com/category_lighting.aspx.

Pool & Landscape Lighting, Outdoor Applications, downloaded Aug. 13, 2007, © 2004 Pool and Landscape Lighting, available at www.pllighting.co.za/page3.html.

New York Times Article, Everything is Illuminated, Ernest Beck, Sep. 29, 2005.

* cited by examiner

*Primary Examiner*—Jason Moon Han
(74) *Attorney, Agent, or Firm*—Gordon & Jacobson, PC

(57) ABSTRACT

A lighted panel system for a tub wall comprising a light diffusing panel, a light source that illuminates the light diffusing panel, and a mounting structure that couples the light diffusing panel to the tub wall. The light diffusing panel comprises a formed transparent or translucent sheet to which the light source is mounted. The light source comprises a plurality of light emitting diode lamps mounted on a circuit board protected by a circular rubber boot that attaches to a rear surface of the light diffusing panel such that light rays are dispersed in a principally lateral direction, parallel to the wall of the tub. A plurality of the lighted panel systems are preferably installed side by side along the length of a tub wall at the water line, an arrangement that allows for continuous lighting coverage and creates a new ambient effect.

20 Claims, 8 Drawing Sheets

LIGHTED PANEL SYSTEM FOR HOT TUB, SPA, OR POOL INSTALLATION

BACKGROUND OF THE INVENTION

1. Field of the Invention

This invention relates broadly to the field of lighting systems. More particularly, this invention relates to a lighting system for hot tubs, spas, and swimming pools where the lighting system includes a light source housed in a light diffusing panel that directs light in a direction principally parallel to the wall of the hot tub to which the lighting system is mounted.

2. State of the Art

Hot tubs, swim spas, and pools are used for personal enjoyment, exercise, and physical therapy. Hot tubs and swim spas are frequently used for treating sore muscles, relaxing after a long day, exercising, or following a rigorous workout. Pools are often used for these purposes, as well as for cooling off on a warm day, playing sports such as water polo, lounging with friends or family, or enjoying a festive event, such as a pool party.

These activities often occur outside after dark or inside in areas without sufficient overhead lighting. Lighting systems are often mounted in hot tubs, swim spas, above-ground pools, and in-ground pools in order to enable their use, enjoyment, and safety when used outside after dark, or indoors at insufficiently lit locations. Such lighting systems also provide a safety purpose, such as highlighting the hot tub's or pool's borders and swimming areas, both for the users and for onlookers, curious children, or people passing by the area. These lighting systems also help to create a positive atmosphere or ambience, which may change as a function of the brightness of the lights, the types and colors of the lights, the number of light sources, and the location of the light sources relative to the users.

Lighting systems in hot tubs or pools have historically involved placing point light sources below the water level in water tight fixtures that either slightly protrude from the walls of the hot tub or pool, or, more commonly, are recessed within a niche formed into the walls to which they are mounted. Light is typically supplied from an incandescent light bulb or a light emitting diode (LED) lamp placed in the fixture. Installations such as those described in U.S. Pat. No. 7,244,037 connect one or more of such fixtures to a wall, thereby lighting the body of water contained therein.

The lighting systems in the art all involve one or more point light sources of varying brightness placed below the water line. These light sources propagate light into a body of water in a direction principally perpendicular to the wall on which the light source is mounted.

SUMMARY OF THE INVENTION

The present invention is directed to a lighted panel system for use in hot tubs, swim spas, and swimming pools (hereinafter, collectively referred to as "tub") that is mounted to the wall or lining of a tub. The lighted panel system comprises a light diffusing panel, a light source that illuminates the light diffusing panel, and a mounting structure that couples the light diffusing panel to the tub wall. Diffusers are preferably provided to the light diffusing panel in line with the light source and mounting structure to decoratively hide such components and further diffuse the light.

More particularly, the light diffusing panel comprises a formed transparent or translucent sheet of plastic, preferably made from a durable polycarbonate thermoplastic resin or acrylic polyethylene. The sheet includes a front service having a plurality of grooves that give the appearance of a plurality of tiles. The style of the grooves can vary to match or blend with the design of the wall of the tub to which the light diffusing panel is attached. In one embodiment of the invention, the grooves define four equally sized rectangular integrated tile portions. The sheet also includes a rear surface that is preferably sand blasted, etched, or otherwise textured to assist with diffusing the light, and, optionally, to illustrate an image through the light diffusing panel to the user. The front surface of the sheet may alternatively or additionally be textured. In addition, or, alternatively, the sheet itself may be somewhat translucent by formation, e.g., having a cloudy or smoked appearance. This texturing of at least one of the front surface, the rear surface, and/or the light transmissive quality of the material of the sheet itself is deemed to render the light diffusing panel "light diffusing." The rear surface contains a recess running along the outer perimeter thereof for receiving sealant.

The light source includes a plurality of LED lamps mounted on a circuit board retained relative to the light diffusing panel, preferably wiring coupling the circuit board to a step down power supply, and a control unit through which a user interacts with a plurality of such lighted panel systems. In a preferred embodiment, the circuit board is provided with two LED lamps that point in opposite directions, both of which are parallel to the front surface of the light diffusing panel, and consequently, to the wall of the tub in which the light diffusing panel is mounted.

In a preferred embodiment, the mounting structure includes two tubular conduits threaded at one end that are placed through holes drilled through a wall of a tub. A nut, in conjunction with sealant, engages with a threaded end of the tubular conduit and secures the light diffusing panel to the wall of a tub in a watertight manner. A rubber boot coupled to the light source wiring fits around the tubular conduit via a friction fit and retains the LED lamps within the panel.

The lighted panel system may be installed in at least a part of a wall of a tub, and is preferably placed at water level with half of the light diffusing panel above the water line and half of it below the water line. A plurality of light diffusing panels can be arranged in series, and preferably, side by side in contact with each other at the same level along the wall, thereby creating continuous light coverage along the wall or around the entire tub.

The lighted panel system creates a new appearance and ambiance resulting from the glow of the light diffusing panels at waterline level, which diffuse and conduct light in a principally lateral direction around the perimeter of the tub. The lighted panel system will not produce the glare typically associated with point light sources or light reflecting off of the water. It will instead project a different lighting effect, one that will help to create the relaxed feeling associated with being in a tub outside at night or indoors. By diffusing the light and channeling it in a principally lateral direction, the light source will appear to the user as glowing tiles along the water's edge rather than as point light sources below the water. In addition, the lighted panel system will provide better lighting coverage for the user in the tub through its potentially continuous coverage around the perimeter of the tub.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
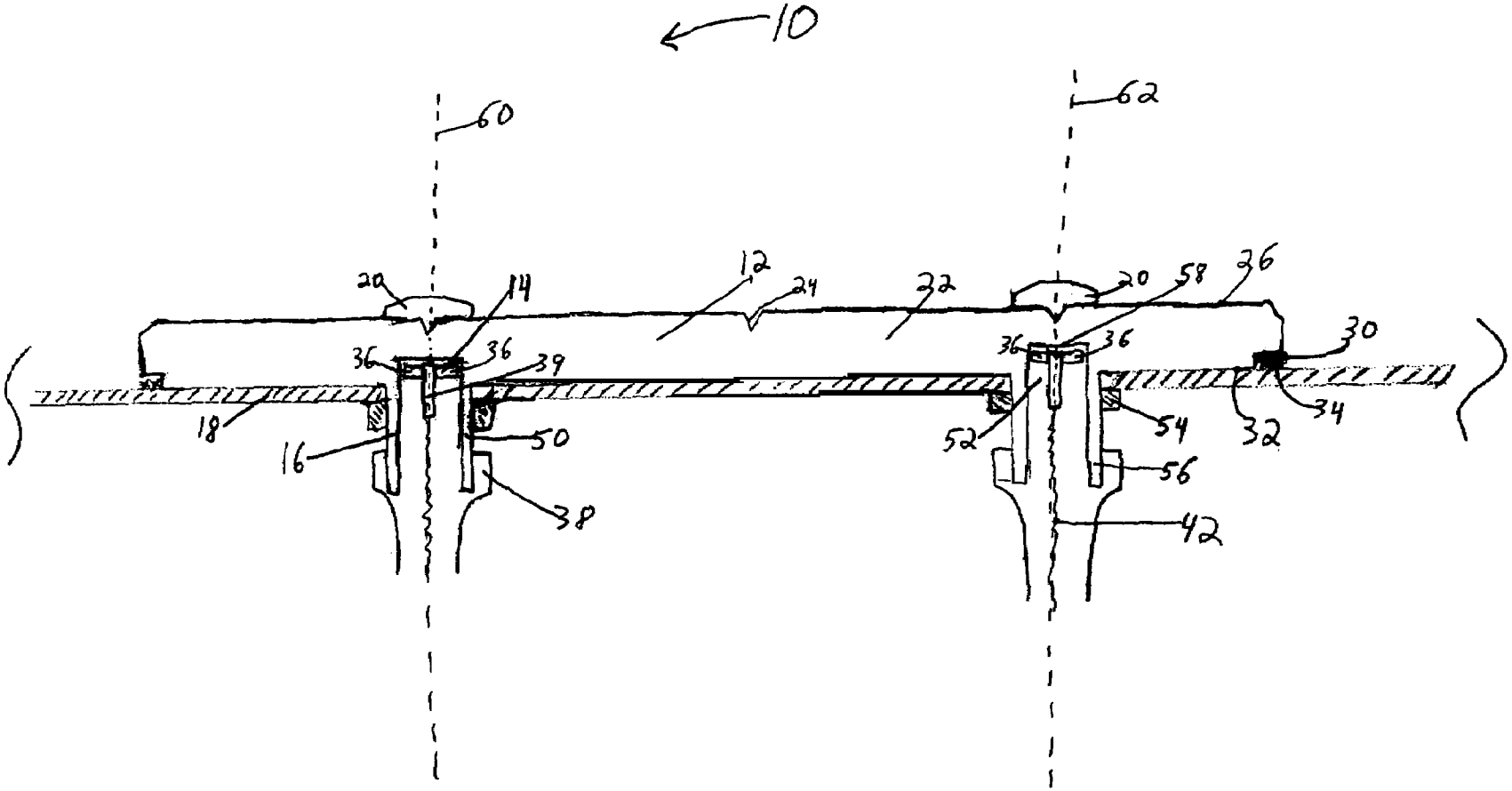
FIG. 1 is a longitudinal section view of a lighted panel system according to the invention installed in a tub wall.

Turning now to FIG. 1, shown is a longitudinal section view of a lighted panel system 10 according to the invention. As described in more detail below, the lighted panel system 10 includes a light diffusing panel 12, a light source 14 that illuminates the light diffusing panel 12, and a mounting structure 16 that couples the light diffusing panel 12 to a wall/lining 18 of a tub. Diffusers 20 are preferably provided to a front surface 26 of the light diffusing panel 12 in line with each light source 14 to decoratively mask each light source 14 and further diffuse the light.

The light diffusing panel 12 comprises a formed transparent or translucent sheet 22 of plastic, preferably made from a durable polycarbonate thermoplastic resin such as LEXAN or acrylic polyethelyne. The sheet 22 comprises a plurality of preferably vertical grooves 24 on the front surface 26 of the sheet 22. The style of the vertical grooves 24 can vary to match or blend with the design of the wall 18 of the tub to which the light diffusing panel 12 is attached. In one embodiment of the invention, the vertical grooves 24 cut into or are otherwise defined in the front surface 26 of the light diffusing panel 12 run from a top side 25 of the front surface 26 to a bottom side 27 (FIG. 2) of the front surface to define four equally sized integrated tile portions 28 such that the panel has the appearance of several tiles. By way of example, the light diffusing panel 12 is preferably approximately four inches in height by eight inches in width, and each tile portion 28 is preferably approximately four inches in height by two inches in length. (FIG. 2).

Figure 2:
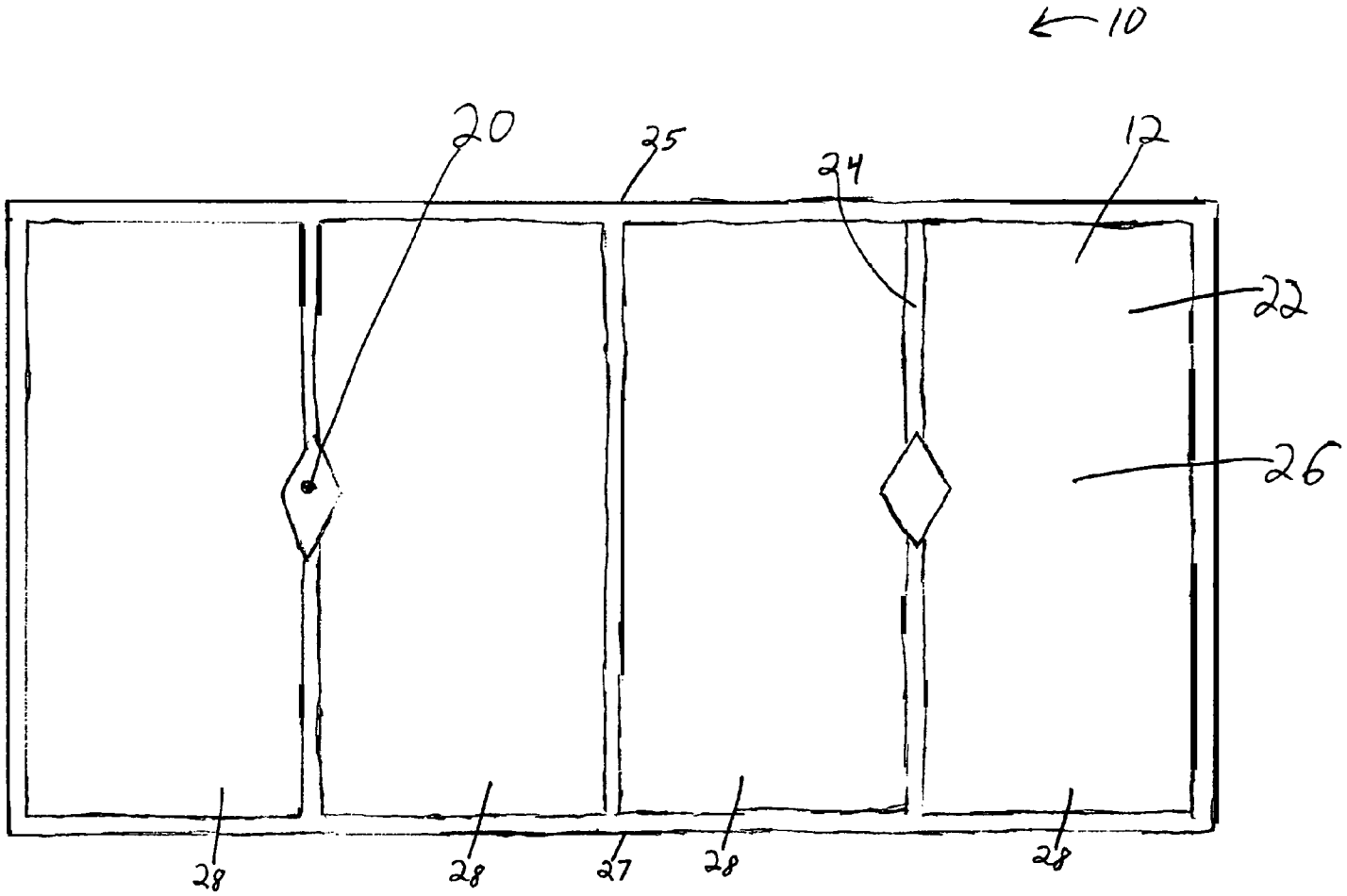
FIG. 2 is a front view of the lighted panel system of FIG. 1.
Figure 3:
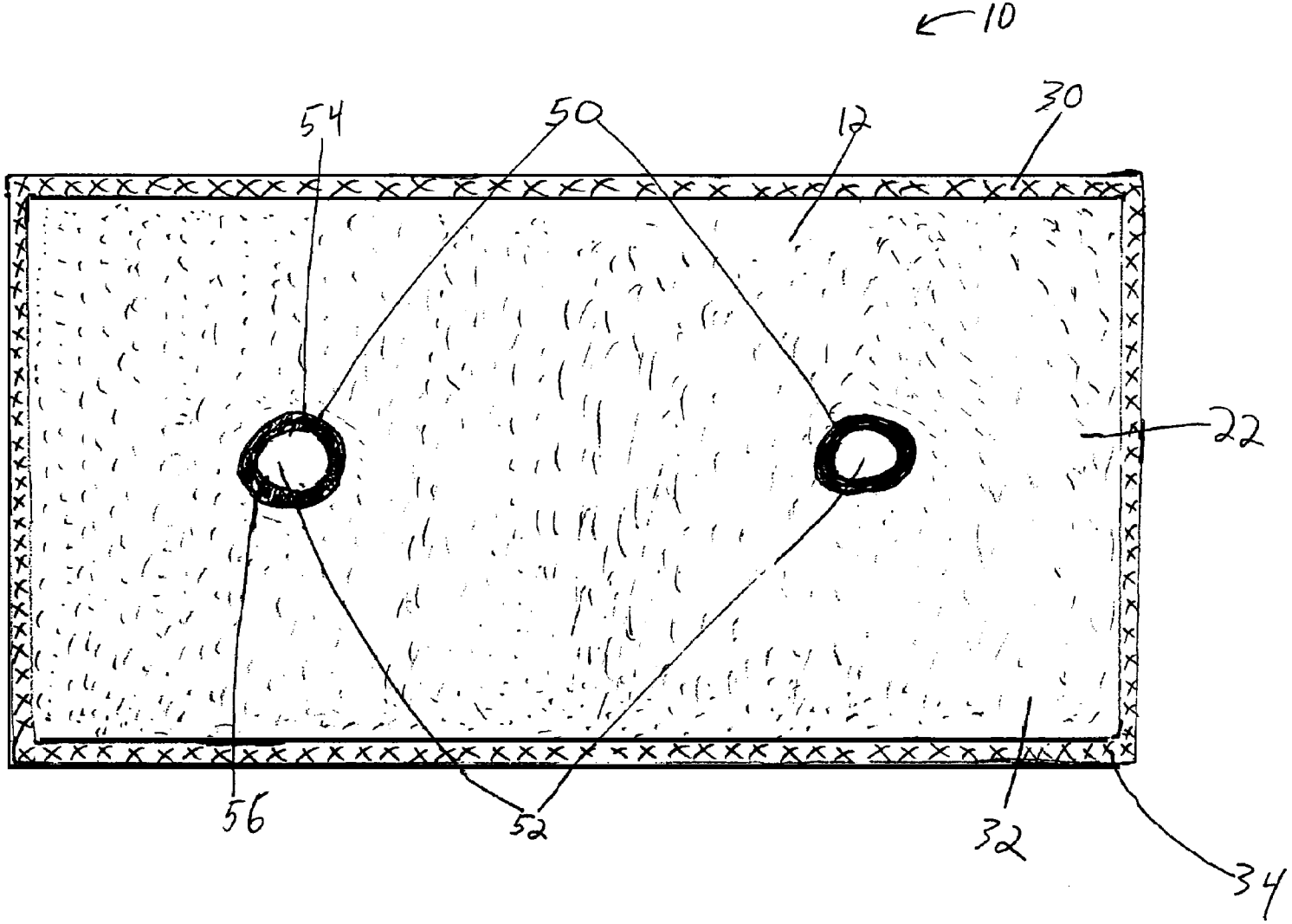
FIG. 3 is a rear view of the lighted panel system of FIG. 1.
Figure 4A:
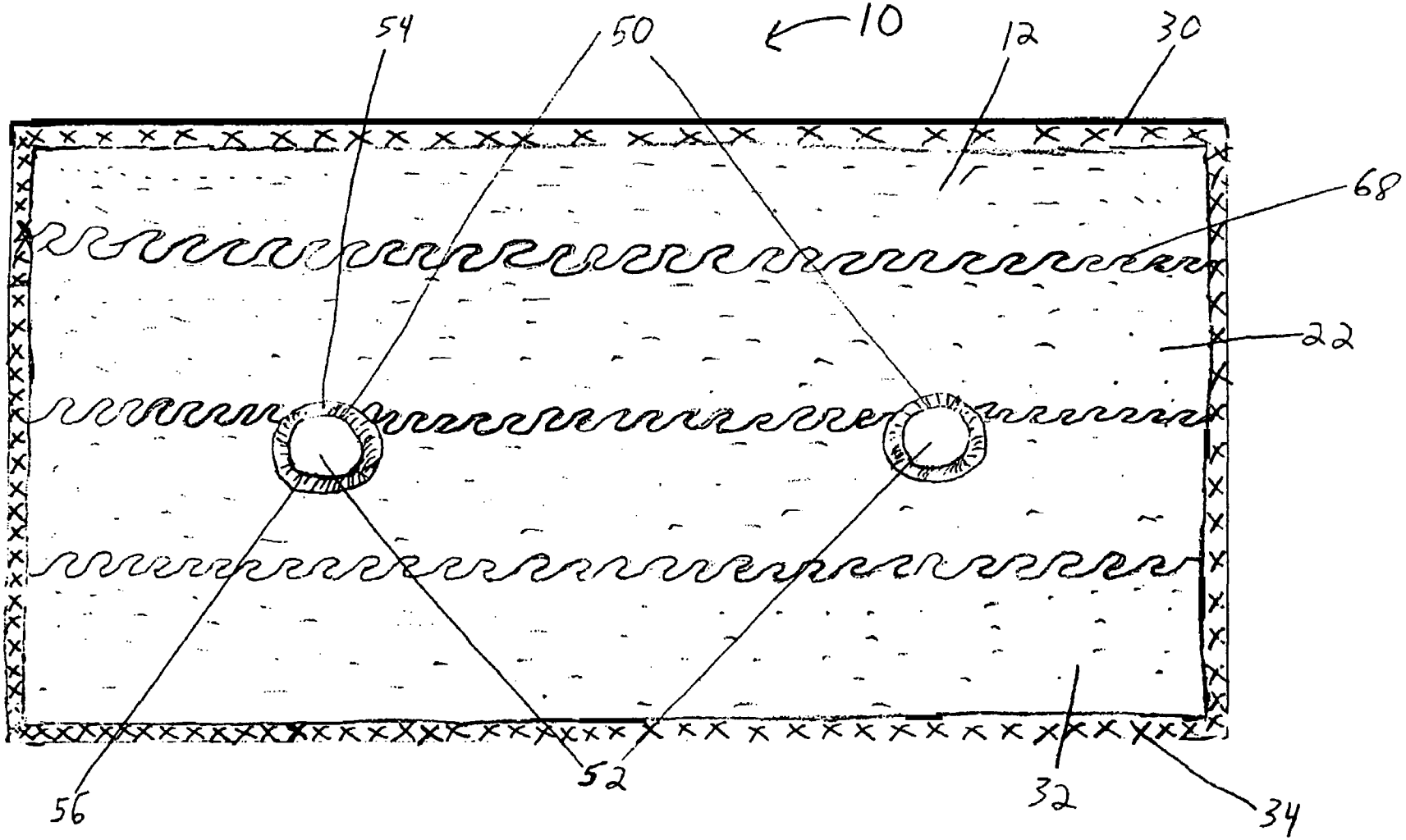
FIGS. 4A-4C show rear views of the lighted panel system of FIG. 1 with exemplary decorative designs.
Figure 4B:
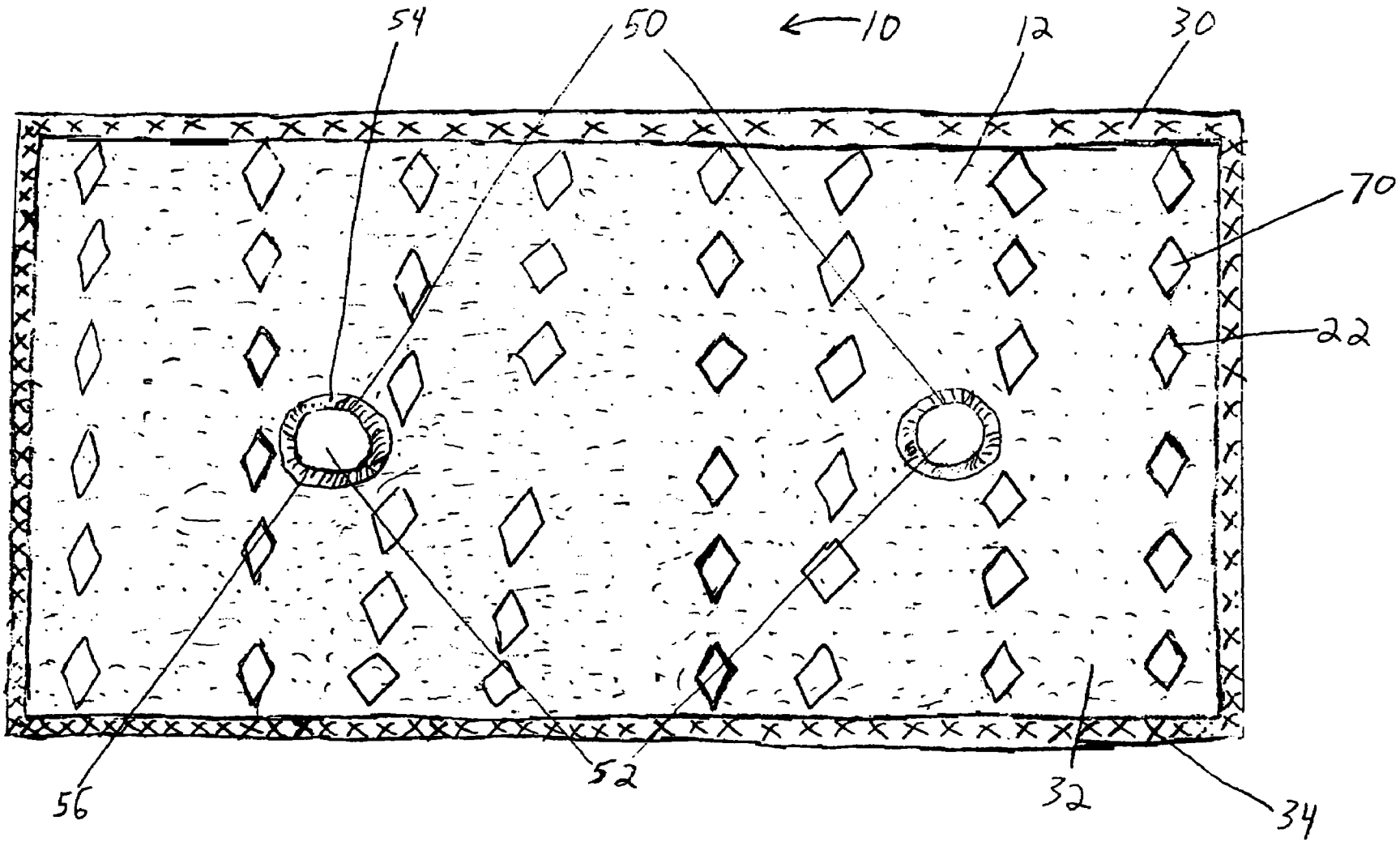
Figure 4C:
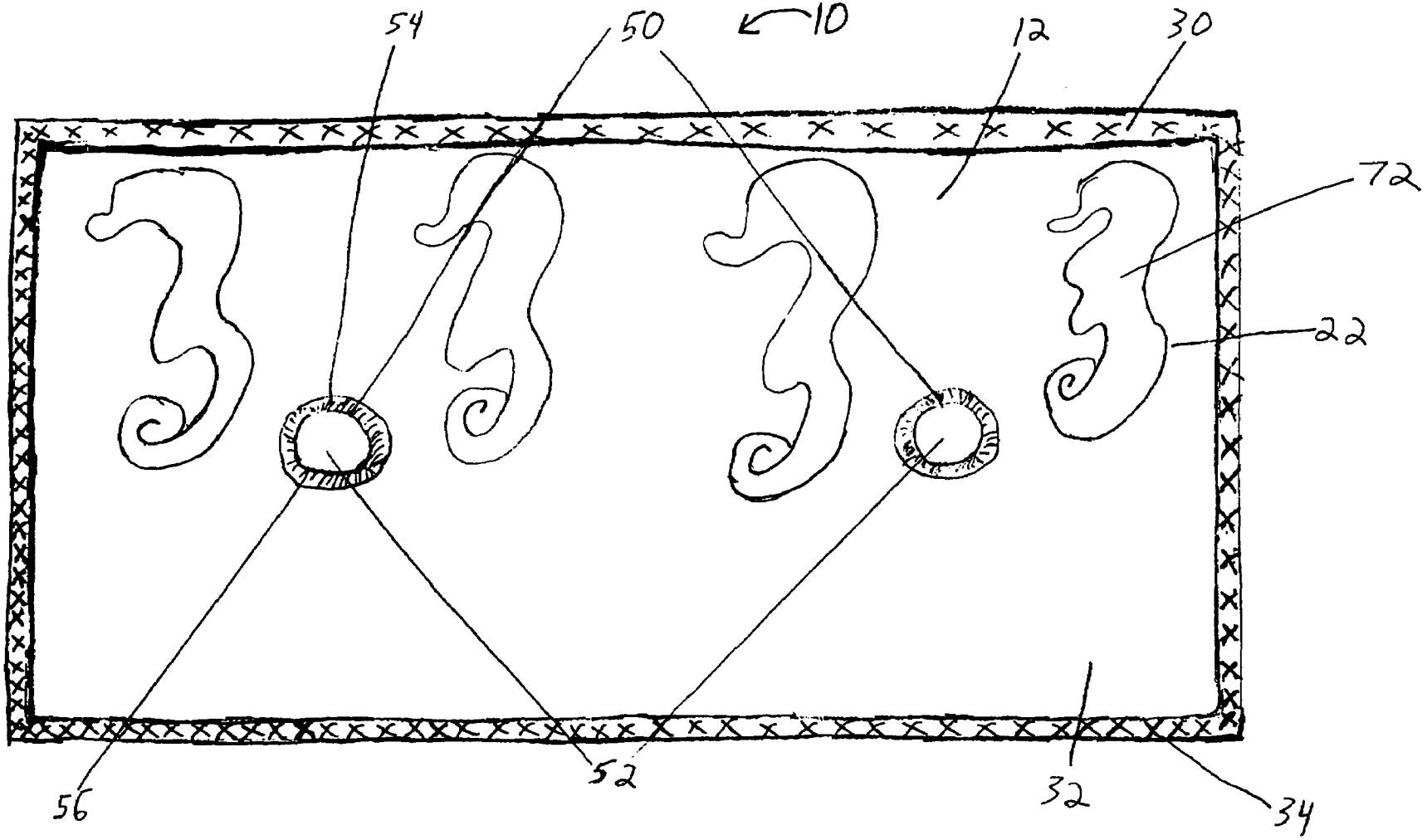

Referring to FIGS. 1-3, the light diffusing panel 12 further includes a recess 30 defined about the perimeter of a rear surface 32 of the sheet 22. The front surface 26 and rear surface 32 of the sheet 22 are preferably planar. In assembly, sealant 34 is placed in the recess 30 between the rear surface 32 and the tub wall 18 to help prevent water from leaking out of the tub. The rear surface 32 of the sheet 22 is preferably sand blasted, etched, or otherwise textured to assist with diffusing the light and masking the wall of the tub. The front surface 26 of the sheet 22 may also be textured, and the sheet itself may be translucent, having a cloudy or smoked appearance. At least one of the front surface 26 or the rear surface 32 should be textured and/or the panel translucent to render the panel 12 "light diffusing." In one embodiment of the invention, an image can be textured into the rear surface 32 of the light diffusing panel 12. Examples of such images are shown in FIGS. 4A-4C, which illustrate a wave design 68 (FIG. 4A), a diamond design 70 (FIG. 4B), and a seahorse design 72 (FIG. 4C), respectively. Likewise, such imaging can be placed in the front surface 26 of the panel 12.

Turning back to FIG. 1, the light source 14 of the lighted panel system 10 comprises a plurality of LED lamps 36 that light the light diffusing panel 12. In a preferred embodiment, two LED lamps 36 are mounted to a circuit board 39 protected by a circular rubber boot 38 that is inserted over a tubular conduit 50 provided at the rear surface 32 of the light diffusing panel 12. The two LED lamps 36 point in opposite directions, both of which are parallel to the front surface 26 of the sheet 22, and consequently, to the wall 18 of the tub in which the light diffusing panel 12 is mounted. The LED lamps 36 are preferably RGB, but can be monochromatic.

Figure 6:
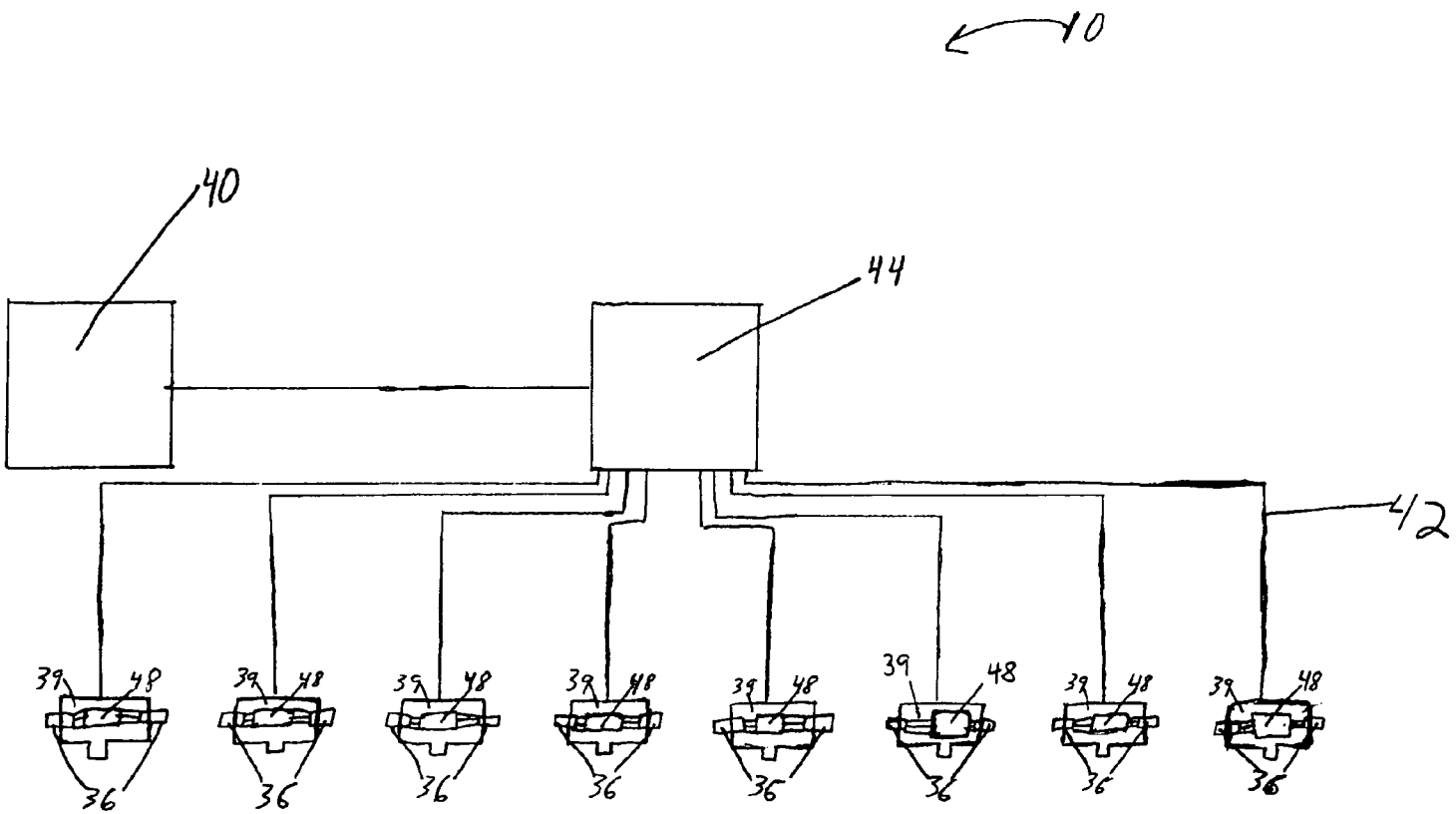
FIG. 6 is a schematic of the step down power supply, control unit, wiring, driver circuit, and LED lamps of the lighted panel system of FIG. 1.

A schematic illustrating the operation of the light source 14 of the lighted panel system 10 is shown in FIG. 6. As shown, the light source 14 further comprises a step down power supply 40, wiring 42, a control unit 44, and a driver circuit 48. The step down power supply 40 supplies AC current into the control unit 44. The control unit 44 converts the AC current into DC current in order to drive the LED lamps 36. The control unit 44 also allows the user to control the specific colors desired for the light diffusing panels 12 and/or to run preset programs that drive the actuation of the light diffusing panels 12. The control unit 44 sends both DC current and various commands to the driver circuit 48 that actuates the LED lamps 36. The LED lamps 36 then convert the signal from the driver circuit 48.

Turning back to FIG. 1, in one embodiment of the invention, the mounting structure 16 comprises two tubular conduits 50 formed at the rear surface 32 of the sheet 22 of the light diffusing panel 12. The tubular conduits 50 are placed through holes 52 drilled into the tub wall 18. A nut 54 or other fastener is fastened around the tubular conduit 50, which is preferably threaded at a first open end 56, and used to secure the tubular conduit 50, and consequently the light diffusing panel 12, to the wall 18 of the tub. Sealant 34 is preferably placed between the nut 54 or fastener and the wall 18 or lining of the tub to form a tight seal. Sealant 34 may also be placed between the inner diameter of the nut 54 and the outer diameter of the tubular conduit 50 to further prevent any water leakage. Alternatively, the tubular conduits 50 may be received through grommets in the tub wall 18 as disclosed in U.S. Pat. Nos. 5,920,924 and 6,094,754, which are incorporated by reference herein. In yet another embodiment of the invention, the tubular conduits 50 may be attached as separate pieces that screw into the sheet 22. In such a design, threaded holes could be drilled into the sheet 22 to accommodate the tubular conduits 50.

The wiring 42, circuit board 39, driver circuit 48, LED lamps 36, and circular rubber boot 38 are inserted through the first open end 56 of the tubular conduit 50 and through the channel defined by the tubular conduit 50 and the panel 12 to a position between the front and rear surfaces 26, 32 of the panel 12. In another embodiment of the invention, the light source 14 may be attached to the light diffusing panel 12 by an additional mount that is attached to the tubular conduits 50 at a second fixed end 58. Other fastening devices may also be used to attach the light diffusing panel 12 to the wall 18 of the tub, and to connect the light source 14 to the light diffusing panel 12.

In the embodiment of the invention depicted in FIG. 1, the tubular conduits 50 are provided at the rear surface 32 of the sheet 22 along axes 60, 62 perpendicular to first and third grooves 24 cut into the front surface 26 of the sheet 22. This arrangement of the tubular conduits 50 places the LED lamps 36 directly behind two of the vertical grooves 24 cut into the front surface 26 of the sheet 22 with each LED lamp directed laterally into a single tile portion 28. Each LED lamp 36 thus lights its own tile portion 28 (FIG. 2).

The diffusers 20 are preferably attached to the light diffusing panel 12 on the front surface 26 of the sheet 22 at the vertical grooves 24 just opposite the LED lamps 36. The diffusers 20 have a preferably larger cross section than that of the tubular conduits 50 formed at the rear surface 32 of the light diffusing panel 12. When placed on the front surface 26 of the sheet 22, the diffusers 20 will thus mask the LED lamps 36, as well as the tubular conduits 50 and any wrinkles or indentations in the sheet 22 resulting from forming the tubular conduits 50. The diffusers 20 are also preferably faceted to assist with diffusing the light.

When the LED lamps 36 are actuated, light is directed in a principally lateral direction, parallel to the tub wall 18. The sheet 22 disperses and diffuses the light throughout the light diffusing panel 12. The diffusers 20, when placed at the vertical grooves 24 just above each LED lamp 36, help to diffuse the light along the tiles 28 and mask the presence of the LED lamps 36 from the user. As at least one of the rear surface 32, the front surface 26, and the sheet 22 material itself are preferably textured, the user will not be able to see the tub wall 18 behind the light diffusing panel 12. The user will instead see the textured surface or image on the rear surface 32 of the light diffusing panel 12, which will be visible through the sheet 22.

Figure 5:
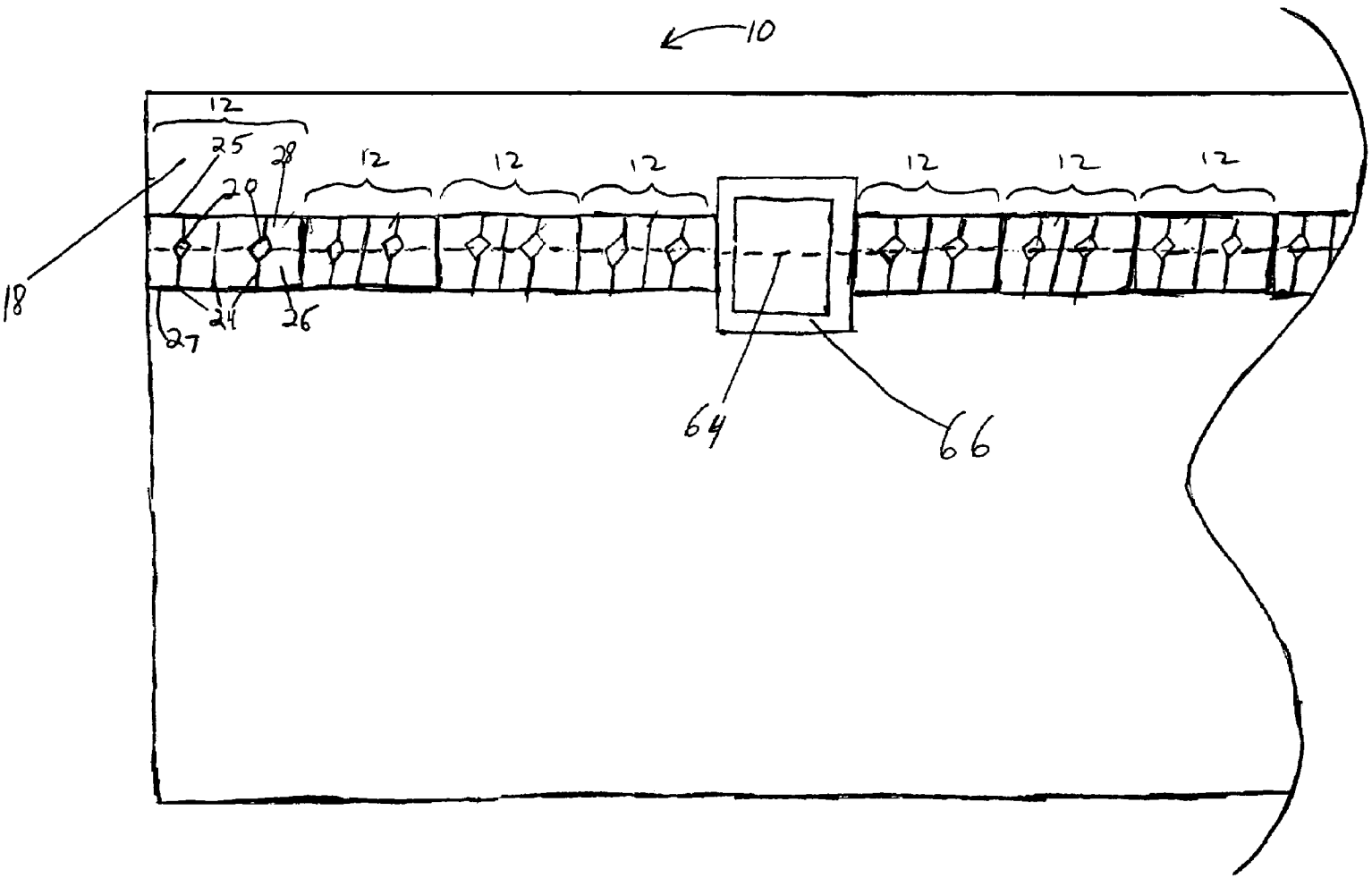
FIG. 5 is a front view of the lighted panel system of FIG. 1 in which multiple light diffusing panels are placed side by side and mounted to the wall or lining of a tub.

The invention is meant to be installed along at least a part of a wall 18 of a tub at water level. As shown in FIG. 5, the light diffusing panels 12 can be arranged in series side by side along the wall 18 of a tub. The light diffusing panels 12 are preferably placed at water line 64, half above and half below it; i.e. at the same level as the tub or pool skimmer 66. When arranged in series, the light diffusing panels 12 will provide continuous lighting coverage along the wall 18 of the tub or around the entire perimeter. The control unit 44 allows the user to control which light diffusing panels 12 are actuated, what colors they will be, and whether they will be lit continuously or, e.g., intermittently in a blinking pattern or prearranged program.

There have been described and illustrated herein several embodiments of a lighted panel system, a tub installation with such lighted panel systems, and methods of installing lighted panel systems in a tub. While particular embodiments of the invention have been described, it is not intended that the invention be limited thereto, as it is intended that the invention be as broad in scope as the art will allow and that the specification be read likewise. Thus, while particular materials, dimensions, circuits, LED lamps, etc. have been disclosed, it will be appreciated that other suitable substitutes can be used as well. It will therefore be appreciated by those skilled in the art that yet other modifications could be made to the provided invention without deviating from its spirit and scope as claimed.

What is claimed is:

1. A lighted panel system for installation in a tub wall, comprising:

a) a light diffusing panel including a front surface and a rear surface;

b) a light source including a plurality of light emitting diode (LED) lamps mounted between said front and rear surfaces, said LED lamps oriented to direct light principally parallel to said rear surface to illuminate said panel; and c) a mounting structure for coupling said light diffusing panel to the tub wall, said mounting structure including at least one conduit integrally formed with said light diffusing panel and extending rearwardly from said rear surface for coupling said light diffusing panel to the tub wall, wherein said light diffusing panel and said at least one conduit together define at least one channel, and said at least one channel extends between said front and rear surfaces of said light diffusing panel, and wherein said plurality of LED lamps are operably disposed inside said at least one channel between said front and rear surfaces.

2. A lighted panel system according to claim 1, wherein: said LED lamps are oriented opposite each other.

3. A lighted panel system according to claim 1, wherein: said front surface has a first side, a second side, and a plurality of grooves running from said first side to said second side such that said front surface defines a plurality of integrated tile portions.

4. A lighted panel system according to claim 1, wherein: said rear surface has a recess running along the outer perimeter of said rear surface.

5. A lighted panel system according to claim 1, wherein: one of said front surface and said rear surface is textured.

6. A lighted panel system according to claim 1, wherein: said light diffusing panel between said front and rear surfaces is translucent.

7. A lighted panel system according to claim 1, wherein: said light source further comprises a circuit board on which said LED lamps are mounted, and a driving circuit provided on said circuit board.

8. A lighted panel system according to claim 1, wherein: at least one conduit is tubular, said tubular conduit includes a threaded portion, and said mounting structure includes a nut that engages with said threaded portion to clamp the tub wall between the rear surface of said panel and said nut.

9. A lighted panel system according to claim 1, wherein: said light diffusing panel further comprises a plurality of diffusers attached to said front surface in line with said LED lamps and said tubular conduits such that said diffusers conceal said LED lamps and said tubular conduits.

10. A lighted panel system for installation in a tub wall, comprising:

a) a light diffusing panel including a front surface and a rear surface, said front surface having at least one groove defining a plurality of integrated tile portions along said front surface, and said rear surface having a recess running along an outer perimeter of said rear surface;

b) a light source comprising two light emitting diode (LED) lamps oriented opposite each other, said light source located between said front and rear surfaces in alignment with one of said grooves such that each of said two LED lamps is directed to illuminate a tile portion on either side of a respective groove; and c) a mounting structure at which said light diffusing panel is adapted to be coupled to the tub wall, said mounting structure including at least one conduit integrally formed with said light diffusing panel and extending rearwardly from said rear surface for coupling said light diffusing panel to the tub wall, wherein said light diffusing panel and said at least one conduit together define at least one channel, said at least one channel extending between said front and rear surfaces of said light diffusing panel, and wherein said plurality of LED lamps are operably disposed inside said at least one channel between said front and rear surfaces.

11. A lighted panel system according to claim 10, wherein:

said light diffusing panel is made from a transparent or translucent sheet of plastic.

12. A lighted panel system according to claim 10, wherein:

said grooves are vertical and define four equally sized rectangular tile portions in said front surface.

13. A lighted panel system according to claim 12, wherein:

at least one of said front and rear surfaces is textured with a design pattern.

14. A lighted panel system for installation in a tub wall, comprising:

a) a rectangular light diffusing panel including a front surface and a rear surface;

b) a light source including a plurality of light emitting diode (LED) lamps mounted between said front and rear surfaces to illuminate said panel;

c) a plurality of tubular conduits provided at said rear surface and extending rearwardly therefrom, said tubular conduits each including an external threaded portion; and d) a plurality of nuts that engage with the respective threaded portions of said tubular conduits to clamp said panel relative to said nuts about the tub wall, wherein said plurality of LED lamps are operably disposed between said front and rear surfaces inside channels defined by said plurality of tubular conduits and said panel.

15. A lighted panel system according to claim 14, wherein:

said tubular conduits are integrally formed with said panel.

16. A lighted panel system according to claim 14, wherein:

said light source further includes wiring and at least one rubber boot attached to said wiring, said at least one rubber boot coupled about respective outer portions of said tubular conduits.

17. A lighted panel system according to claim 14, wherein:

said light diffusing panel and said at least one conduit are together formed from a plastic material.

18. A tub, comprising:

a) a tub having a tub wall which holds water;

b) a skimmer along said tub wall at water level to skim from a surface of the water;

c) a plurality of lighted panel systems coupled to said tub wall in horizontal alignment with said skimmer, each said lighted panel system comprising a light diffusing panel with a front surface and a rear surface, and a light source having a plurality of light emitting diode (LED) lamps mounted between said front and rear surfaces, said LED lamps oriented to direct light principally parallel to said rear surface; and d) mounting structure for coupling said plurality of lighted panel systems to the tub wall, said mounting structure defining at least one channel, wherein said plurality of LED lamps are operably disposed inside said at least one channel between said front and rear surfaces.

19. A tub according to claim 18, wherein:

said plurality of lighted panel systems further comprise a control unit in communication with said lighted panel systems which regulates the actuation of each light source.

20. A tub according to claim 18, wherein:

said light diffusing panels are attached to said tub wall such that approximately half of each said light diffusing panel is above water level and approximately half of each said light diffusing panel is below water level.

* * * * *